United States Patent [19]

Krug

[11] 4,325,524

[45] Apr. 20, 1982

[54] TRACK MONITORING DEVICE

[75] Inventor: Adolf Krug, Braunschweig, Fed. Rep. of Germany

[73] Assignee: Siemens Aktiengesellschaft, Berlin & Munich, Fed. Rep. of Germany

[21] Appl. No.: 115,009

[22] Filed: Jan. 24, 1980

[30] Foreign Application Priority Data

Mar. 19, 1979 [DE] Fed. Rep. of Germany ..... 2910770

[51] Int. Cl.[3] ..... B61L 25/00; B61L 27/00

[52] U.S. Cl. ..... 246/34 R; 246/77; 246/122 R

[58] Field of Search ..... 246/77, 34 R, 34 A, 246/34 B, 34 CT, 28 R, 167 R, 177, 187 C, 249, 247, 122 R, 63 R, 63 A, 63 C; 340/47; 343/6.5 SS

[56] References Cited

U.S. PATENT DOCUMENTS

| | | | |
|---|---|---|---|
| 3,476,932 | 11/1969 | Gittinger | 246/34 CT |
| 3,888,437 | 6/1975 | Birkin | 246/122 R |
| 3,907,238 | 9/1975 | Sibley et al. | 246/77 |
| 4,128,218 | 12/1978 | Pohlig | 246/77 |

FOREIGN PATENT DOCUMENTS 1244836 7/1967 Fed. Rep. of Germany .

*Primary Examiner*—James J. Groody

*Attorney, Agent, or Firm*—Hill, Van Santen, Steadman, Chiara & Simpson

[57] ABSTRACT

A railroad track monitoring device has a response device disposed at the front and end of every train, the response devices being capable of transmitting one of a number of different signals to a sampling device. The number of signals is at least twice as large as the number of trains on the system. The track is subdivided into a number of successive path segments and an interrogation device is disposed at the boundary of every two adjacent path segments. Each interrogation device has a memory allocated thereto for storing the last-received signal from a train passing the interrogation device, and a series of comparators for comparing the signals received from interrogation devices associated with adjacent track segments releases an occupied signal or a open track signal upon coincidence or difference of the most recently received information from the two track sections behind the front of the train.

4 Claims, 1 Drawing Figure

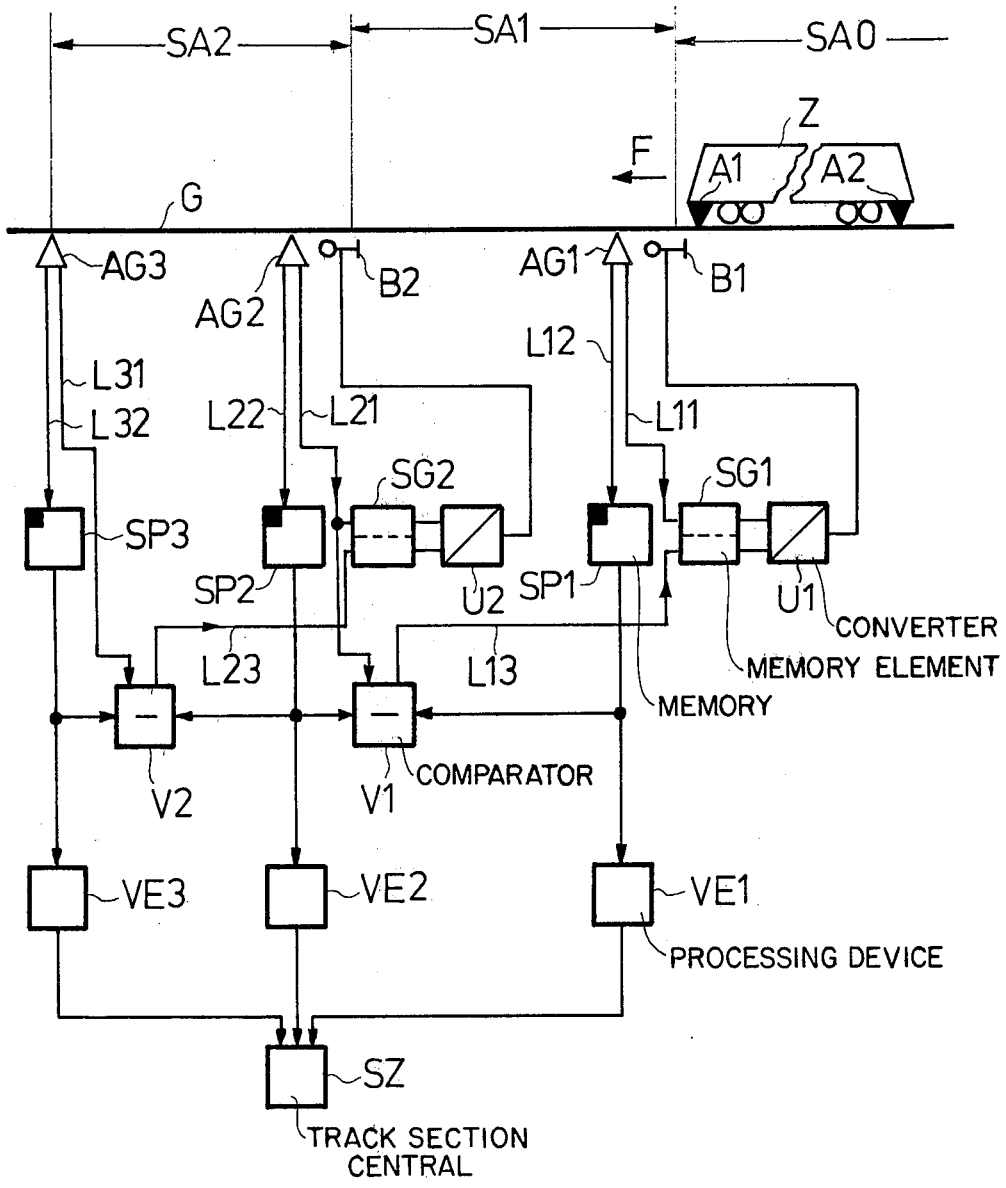
SA2
SA1
SA0
Z
F
A1
A2
G
AG3
AG2
B2
AG1
B1
L12
L31
L32
L22
L21
L11
SG2
SG1
SP3
SP2
U2
SP1
U1
CONVERTER
MEMORY ELEMENT
L23
L13
MEMORY
V2
V1
COMPARATOR
VE3
VE2
VE1
PROCESSING DEVICE
SZ
TRACK SECTION
CENTRAL

TRACK MONITORING DEVICE

BACKGROUND OF THE INVENTION

The invention relates to a track monitoring device in which respective interrogation devices are provided at the boundaries of successive track sections, which interrogation devices trigger an occupied signal or a release signal, respectively, for the track section lying in front of or behind the train, as viewed in the direction of travel thereof, on the basis of reception of data, respectively, coded in a response device at the front and at the back end of each train regularly travelling over the track section.

A device of this type is known from German AS No. 1,244,836, and which may utilize as the response devices, a permanent magnet, a radioactive compound or some other body reflecting or emitting a beam. Such response devices respectively contain a uniform information for all trains as to whether the head of a train or, respectively, the end of a train is present. Thus, based on the reception of a proper sequence of train head and train end data by an interrogation device, the occupation of a track section lying ahead and the orderly clearance or release of the track section lying behind a train can be determined at the boundary between two track sections.

However, it is necessary that care be taken in equipping trains whereby response devices are arranged at the train head or at the train end to insure that train end data is supplied in proper sequence. Obviously, an improper arrangement of the response devices would prevent the orderly operation of the system. Further, in the event a train changes its direction of travel, for example with a switch-back, the appropriate response devices must always be interchanged.

SUMMARY OF THE INVENTION

The invention has as its principal objective, the production of a monitoring device of the type initially referred to by means of which a predetermined plurality of n trains can be respectively equipped in any desired manner with one of 2n response devices at the respective ends of the train.

This objective is achieved in accordance with the invention by utilizing one data part of a plurality of predetermined data part, which data part is allocated to each response device, with said plurality of data parts, being at least twice as great as the plurality of regular trains. Switching means is provided for triggering the release of an occupied report or signal of the respective track section lying immediately ahead in the direction of travel of the train upon reception of such a data part, with each interrogation device having allocated to it memories for storing respective data last received, in combination with a cooperable comparison device for triggering the release of a release or clearance report or signal upon coincidence of the currently received information with the information last received at the boundary between the two track sections lying rearward in the direction of travel. Advantageously, in accordance with one advantageous feature of the invention the respective interrogation devices are disposed at an interval, in the direction of travel from the boundary between two track sections, which interval at least corresponds to the shortest allowable over-run length for the trains. By this arrangement, a particularly good matching of the device to the existing signal system is assured.

A further advantageous feature of the invention is that the contents of the memories can be supplied to a track section central, as a result of which a train tracking, as a pre-condition of train routing for dispositional purposes, can also be realized with the track monitoring device which is constructed in accordance with desirable requirements of safety engineering.

The comparison of the received information may likewise be carried out at the track section central which has to be designed advantageously as a fail-safe control mechanism switching device.

BRIEF SUMMARY OF THE DRAWING

The FIGURE of the drawing illustrates in semi-diagrammatic and schematic from a circuit diagram, in block form of a monitoring system in accordance with the present invention.

DETAILED DESCRIPTION

Referring to the drawing, the reference numeral Z designates a train (only the front end and the rear end being illustrated) which is travelling over a track G in the direction of travel F indicated by an arrow. Such train may pass through successive track sections SA0, SA1 and SA2, the respective lengths of which are greater than the maximum train lengths. Entry into the next successive track sections is controlled by respective block signals B1 or B2, etc. It will be assumed then that the train Z is disposed in track section SA0 and has authorized entry, by means of the block signal B1, into track section SA1.

Upon entry into such track section, a response device A1 (indicated by a solid triangle) disposed at the head of the train Z suitably influences an interrogation device AG1 (indicated by means of an open triangle) at the track section. The interrogation device AG1 is disposed in spaced relation with respect to block signal B1, in the direction of travel F by an allowable over-run distance. Such interrogation device AG1, upon being subjected to the influence of the response device, in this case the response device A1, controls switching means over a line L11, for triggering the release of an occupied report or signal which is supplied to a memory element SG1, and by means of a converter U1, the block signal B1 is set in a "STOP" condition.

Entry of a following train (not illustrated) into the track section SA1, now occupied by train Z is thereby prevented.

The information coded in the response device A1 is supplied from the interrogation device AG1 into a memory SP1 over a line L12, which information can be any desired information of at least 2n different data parts, in which n is the plurality of trains (including the train Z) regularly traversing the track section SA0, SA1 and SA2. When train Z has completely entered into track section SA1, the response device A2 (likewise designated by a solid triangle) disposed at the end of the train influences the interrogation device AG1. One of at least 2n different information parts is also allocated to the response device A2. The renewed influencing of the interrogation device AG1 by a response device, in this case the response device A2, results in the memory element SG1 remaining in the position previously set. However, the information coded in the response device A2 is now stored in memory SP1 as current information. When in the course of further travel, the train Z enters the track section SA2, the response device A1 and A2 respectively trigger the setting of a memory element SG2 over an interrogation device AG2 (arranged behind the block signal B2 in the direction of travel F by the over-run length) and a line L21, with the memory element SG2 then setting the block signal B2 to "STOP" over a converter U2. Thus, the memory element SG2 and the converter U2 also represent switching means for triggering the release of an occupied report.

The data of the response devices A1 and A2 are supplied in succession to a memory SP2 over line L22. While over the line L21, the presence of the information of a response device A1 or A2 respectively effects a comparison of the memory content of memory SP1 with that of memory SP2 by means of a comparator V1. In the event the comparison indicates identity of the respective memory contents, the memory element SG1 is reset over a line L13 whereby the block signal B1 is again set over the converter U1 to "CLEAR", whereby the track section SA1 is again released for the entry of following trains, not illustrated.

As train Z continues to travel in the assumed direction F, an interrogation device AG3 disposed at the end of the track section SA2 detects the information of the response devices A1 and A2 in succession, which are supplied over a line L32 to a memory SP3 and is supplied over line to a comparison device such as the comparator V2 which effects a comparison of the contents of the memory SP2 and that of the memory SP3. In the event an identity of the contents of the memories SP2 and SP3 exists, the memory element SG2 is reset over a line L23, resulting in the block signal B2 again being set over the converter U2 to "CLEAR", whereby the track section SA2 is now free for the entry of following trains, not illustrated.

The contents of memories SP1, SP2 and SP3 can be supplied, over suitable processing devices VE1, VE2 and VE3 to a track section central SZ which can then undertake a train monitoring operation on the basis of the information supplied to the memory SP1, SP2 and SP3.

In those cases where the response devices A1 and A2 have a very large information content, and in particular, when the information can thereby be readily set from the train cab, the device can also serve to transmit vehicle-specific information to the track section central. However, it must be assured that the train information is respectively different from the train head information of a following train. The insertion of additional response devices between the response device at the head and the response device at the end of the train is thereby allowable without problem.

In the example referred to, only the regular blocking of track sections lying behind the train, in the direction of travel, is illustrated. If, after a release report or signal of a block signal the response device arranged at the end of the train influences the previously released block signal, for example because the train has rolled back into the section just left, switching means can be provided which detect this and, in this case, again throw the block signal involved to "STOP". Such a "STOP" report or signal can only be removed by a subsequent train following permissively.

In the event a normal entering and a permissively entering trains are disposed in one track section, a release report can result only when the rear-end response device of the permissive train has properly cleared the occupied track section.

Such a permissive entry can result either over a special command system or a specific, third signal provided at the respective block signal.

A track monitoring device in accordance with the invention is completely compatible with additional track monitoring devices. Thus, for example, at the beginning of a track section area equipped according to the invention, a magnetic train stop can be arranged, following the first interrogation devices whereby such train stop is actuated when the block signal behind it is switched to "CLEAR", whereby the magnetic train stop is switched off by means of the first clear reading of a response device of an equipped train. Thereby, it is assured that only trains so equipped according to the invention can enter into the track section area without an automatic train stop.

Although I have described my invention by reference to particular illustrative embodiments, many changes and modifications of the invention may become apparent to those skilled in the art without departing from the spirit and scope of the invention. I therefore intend to include within the patent warranted hereon all such changes and modifications as may reasonably and properly be included within the scope of my contribution to the art.

I claim as my invention:

1. In a track monitoring device in which individual interrogation devices are provided at the respective boundaries between succeeding track sections, which interrogation devices respectively trigger the release of an occupied or release report for the track section which, in the direction of travel, lies ahead of or behind the train involved, on the basis of the reception of data respectively coded in a response device at the head and at the rear end of each train regularly traversing the track sections, the combination of each response device having allocated thereto one data part of a plurality of predetermined data parts, which plurality is at least twice as great as the plurality of regular trains, switching means responsive to the respective interrogation devices for triggering an occupied report of the track section respectively lying directly ahead, in the direction of travel of the train, allocated to each interrogation device, a memory for each interrogation device for storing data respectively received last, and a comparison device for comparing the memory contents of adjacent triggered memories for triggering a release report upon coincidence of the currently received data with the last received data at the last boundary between two track sections, which boundary lies rearward in the direction of travel.

2. A track monitoring device according to claim 1, wherein each interrogation device is disposed at an interval in the direction of travel, with respect to the boundary of the two adjacent track sections, which interval corresponds to at least the shortest allowable over-run length of the trains involved.

3. A track monitoring device according to claim 1, wherein the data contents of the memories can be supplied to a track section central for use in further train control operations.

4. A track monitoring device according to claim 3, wherein the track section central is designed as a fail-safe control mechanism.

* * * * *